US010947682B2

(12) United States Patent
Foster

(10) Patent No.: US 10,947,682 B2
(45) Date of Patent: Mar. 16, 2021

(54) TEMPORARY BARRIER SYSTEM

(71) Applicant: Roy Allen Foster, Orono (CA)

(72) Inventor: Roy Allen Foster, Orono (CA)

( * ) Notice: Subject to any disclaimer, the term of this patent is extended or adjusted under 35 U.S.C. 154(b) by 0 days.

(21) Appl. No.: 16/424,350

(22) Filed: May 28, 2019

(65) Prior Publication Data

US 2020/0378077 A1 Dec. 3, 2020

(51) Int. Cl.

| | |
|---|---|
| ***E01F 15/06*** | (2006.01) |
| ***E01F 9/608*** | (2016.01) |
| ***B65H 18/10*** | (2006.01) |
| ***E01F 9/646*** | (2016.01) |
| *E01F 13/02* | (2006.01) |

(52) U.S. Cl.

CPC ..... *E01F 9/608* (2016.02); *B65H 18/10* (2013.01); *E01F 9/646* (2016.02); *E01F 15/065* (2013.01); *E01F 13/028* (2013.01)

(58) Field of Classification Search

CPC ..... E01F 13/022; E01F 13/028; E01F 13/04; E01F 13/048; E01F 15/06; E01F 15/10; E01F 15/065

USPC ..... 160/238

See application file for complete search history.

(56) References Cited

U.S. PATENT DOCUMENTS 3,351,322 A * 11/1967 Mueller ..... E01F 15/06 256/13.1
3,353,795 A * 11/1967 Muller ..... E01F 9/635 256/13.1
3,385,565 A * 5/1968 Cuthbert ..... E01F 9/629 256/13.1
3,512,758 A * 5/1970 Robert ..... E01F 15/06 256/13.1
4,119,301 A * 10/1978 Payne ..... E04H 17/10 256/1
4,124,196 A * 11/1978 Hipskind ..... E01F 7/00 116/63 P
5,029,819 A * 7/1991 Kane ..... E01F 13/028 160/24
6,016,986 A * 1/2000 Wright ..... A01K 3/005 242/396.9
6,142,701 A * 11/2000 Falcon ..... E01F 13/028 160/24
6,309,076 B1 * 10/2001 McVicker ..... B60J 1/2041 160/238

(Continued)

*Primary Examiner* — Thomas B Will
*Assistant Examiner* — Katherine J Chu
(74) *Attorney, Agent, or Firm* — Gulf Coast Intellectual Property Group

(57) ABSTRACT

A temporary barrier system that is configured to be placed adjacent a concrete divider on a roadway wherein the temporary barrier system provides an increased vertical barrier so as to inhibit seeing therepast. The temporary barrier system includes a storage container having the body of the present invention stored in its first position therein. The body of the present invention is planar in manner and stored in a rolled position in the storage container. The body is wrapped around a winding apparatus and includes an end that is configured to be secured to a deployment vehicle. The deployment vehicle traverses away from the storage container to deploy the body to its second position. The body further includes a plurality of support members being configured to be perpendicular to the upper and lower edge. The storage container is configured as a towable trailer.

12 Claims, 2 Drawing Sheets

(56) References Cited

U.S. PATENT DOCUMENTS 6,733,204 B1 * 5/2004 Paniccia ..... E01F 7/06 160/238
6,789,979 B1 * 9/2004 Jones ..... E01F 15/06 244/110 C
7,178,790 B2 * 2/2007 de Lorenzo ..... E01F 13/028 160/24
7,217,061 B2 * 5/2007 Stratton ..... E01F 7/00 160/24
7,219,709 B1 * 5/2007 Williams ..... E01F 13/028 160/24
7,377,490 B1 * 5/2008 Khosravian ..... E01F 13/028 119/416
7,600,554 B1 * 10/2009 Wright ..... E01F 7/00 160/327
7,690,858 B1 * 4/2010 Chiavola ..... E01F 13/028 404/6
7,971,622 B2 * 7/2011 Trionfetti ..... E04H 1/1272 160/24
8,087,443 B2 * 1/2012 Snyder ..... E06B 9/08 160/29
8,104,160 B2 * 1/2012 Wohlgemuth ..... B65H 75/446 29/428
8,500,360 B1 * 8/2013 Jones ..... E01F 13/028 404/9
9,598,896 B1 * 3/2017 Pichik ..... E06B 9/13
10,053,888 B2 * 8/2018 Mitchell ..... B65H 75/4471
10,383,463 B2 * 8/2019 Korn ..... A47G 5/02
10,422,091 B1 * 9/2019 Moir ..... E04H 17/18
10,570,577 B2 * 2/2020 Kramer ..... E01F 13/048
2003/0164485 A1 * 9/2003 Olson ..... B21F 33/002 256/37
2006/0131551 A1 * 6/2006 Hopp ..... E01F 13/028 256/21
2007/0176158 A1 * 8/2007 Robinson ..... E01F 13/028 256/12.5
2010/0181544 A1 * 7/2010 Wettern ..... E01F 13/028 256/73
2010/0288450 A1 * 11/2010 Bruck ..... F16M 11/24 160/238
2012/0256149 A1 * 10/2012 Sylvester ..... E01F 13/028 256/73
2013/0048227 A1 * 2/2013 Cannova ..... E01F 13/028 160/10
2013/0306926 A1 * 11/2013 Bock ..... A01K 3/00 256/1
2016/0215462 A1 * 7/2016 Marchetti ..... E01F 7/00
2018/0044868 A1 * 2/2018 Miller ..... E04H 17/00

* cited by examiner

TEMPORARY BARRIER SYSTEM

FIELD OF THE INVENTION

The present invention relates generally to barriers, more specifically but not by way of limitation, a temporary barrier system that is deployable and configured to be operable in conjunction with a permanent barrier or independently thereof wherein the barrier of the present invention inhibits the ability to see objects on the opposing side thereof.

BACKGROUND

Various types of barriers are well known in the art. Barrier types range from crowd control to roadway barriers. Roadway barriers are often constructed in areas of larger traffic volumes intermediate opposing flow of traffic. Conventional roadway barriers, also referred to as dividers, are constructed in various forms ranging from a post/cable design to concrete barriers. The concrete type of barrier/divider are manufactured in sections typically about ten feet in length having a height of about four feet. These concrete barriers have a substantial weight and are operable to inhibit a vehicle from entering the opposing lanes of the road and collide with opposite traffic.

One issue with concrete barriers is their reduced height. The reduced vertical distance of conventional concrete barriers provide the ability for drivers to see on the opposing side thereof. While this is desirable for creating safe driving conditions, it does create problems when an accident occurs on one side of the roadway. In areas of heavy traffic volumes, vehicle accidents can cause significant disruption to the traffic flow and create time consuming delays. Traffic congestion not only creates problems for routine drivers but it further can inhibit access for emergency vehicles. Upon occurrence of an accident roadway traffic is often disrupted in both directions. In the lanes where the accident has occurred, the restricted access around the vehicles involved in the accident causes traffic congestion. Additionally, it is common for the opposite lanes of the roadway to exhibit a delay and/or slowdown. The delay and/or slowing of traffic in opposing lanes from an accident is typically caused by drivers slowing to view the accident on the opposing side of the barrier/divider. The viewing of the accident results in the lanes of traffic becoming congested and can further exacerbate the problems created by the initial accident.

Accordingly, there is a need for temporary barrier that can be rapidly deployed wherein the barrier is configured to be operable in conjunction with conventional concrete roadway dividers wherein the barrier of the present invention provides additional height to the concrete divider so as to inhibit an ability to see on the opposing side of the concrete divider.

SUMMARY OF THE INVENTION

It is the object of the present invention to provide a temporary barrier system configured to be operable in conjunction with a roadway concrete dividing wall wherein the temporary barrier of the present invention is provided in a storage container wherein the preferred embodiment of the storage container is a trailer.

Another object of the present invention is to provide a visual deterrent barrier that is deployed adjacent to a roadway concrete divider so as to inhibit the ability to see therepast wherein the body of the present invention is a material that is stored in a rolled position in the storage container.

A further object of the present invention is to provide a temporary barrier system configured to be operable in conjunction with a roadway concrete dividing wall wherein the body of the present invention includes an end that is configured to be releasably secured to a deployment element in order to be deployed from the storage container.

Still another object of the present invention is to provide a visual deterrent barrier that is deployed adjacent to a roadway concrete divider so as to inhibit the ability to see therepast wherein the body is stored in a rolled position in the storage container on a winding apparatus.

An additional object of the present invention is to provide a temporary barrier system configured to be operable in conjunction with a roadway concrete dividing wall wherein the body of the present invention is planar in manner and includes an upper edge and a lower edge.

Yet a further object of the present invention is to provide a visual deterrent barrier that is deployed adjacent to a roadway concrete divider so as to inhibit the ability to see therepast wherein the deployment element is a vehicle and wherein the vehicle further includes a mounting rod secured thereto that is operable to receive the first end of the body.

Another object of the present invention is to a provide a temporary barrier system configured to be operable in conjunction with a roadway concrete dividing wall wherein the body is deployed in a position such that the lower edge thereof is parallel with the upper edge of a concrete roadway divider.

An alternate object of the present invention is to provide a visual deterrent barrier that is deployed adjacent to a roadway concrete divider so as to inhibit the ability to see therepast wherein the upper edge and lower edge of the body include reinforcing cables formed therein.

An additional object of the present invention is to provide a temporary barrier system configured to be operable in conjunction with a roadway concrete dividing wall wherein the body is formed so as to inhibit sight therethrough but is further configured to allow air to pass therethrough.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
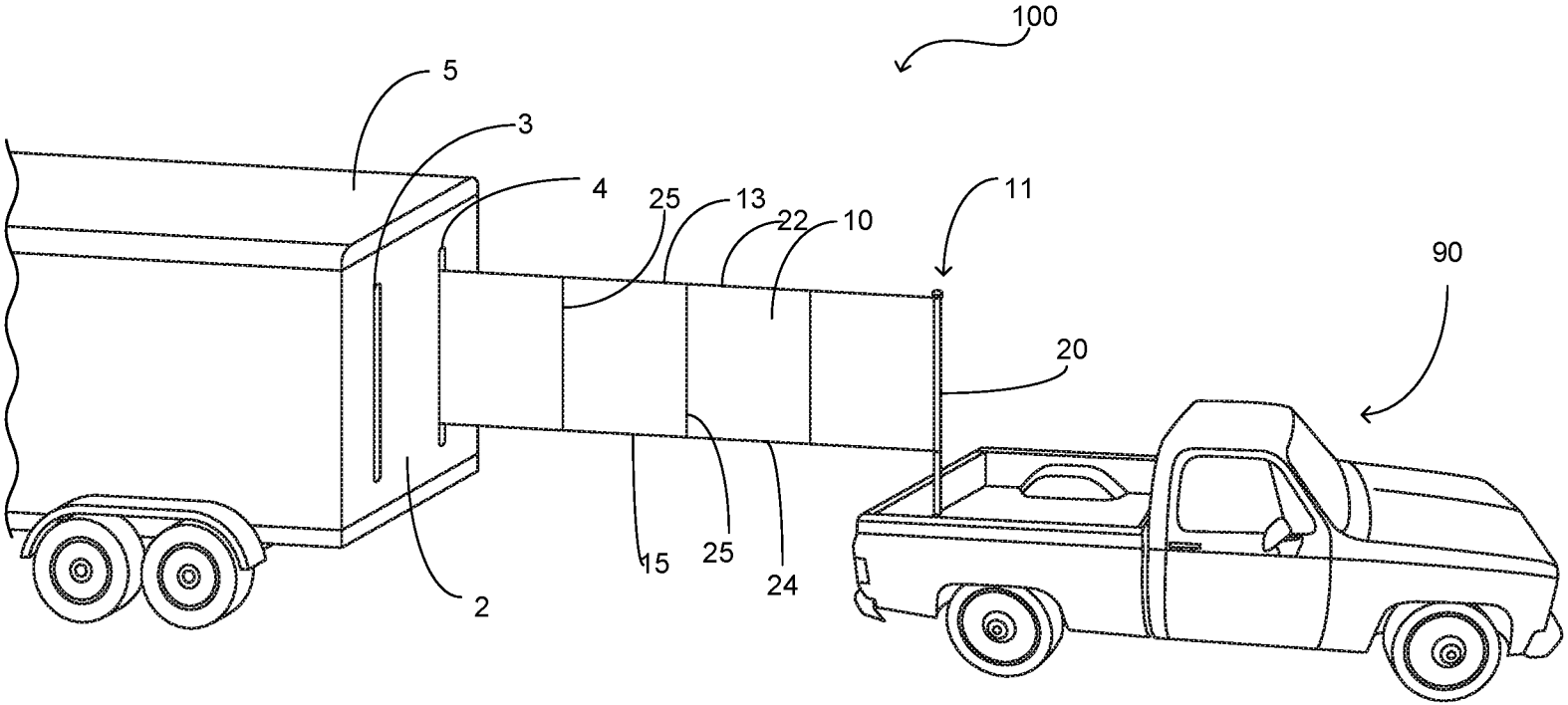
FIG. 1 is a perspective view of the present invention in a deployed state.

Referring now to the drawings submitted herewith, wherein various elements depicted therein are not necessarily drawn to scale and wherein through the views and figures like elements are referenced with identical reference numerals, there is illustrated a temporary barrier system 100 constructed according to the principles of the present invention.

An embodiment of the present invention is discussed herein with reference to the figures submitted herewith.

Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the temporary barrier system 100 includes a body 10 that is stored in container 5 wherein the body 10 is movable intermediate a first position and a second position. The body 10 is illustrated in its second position in FIG. 1 submitted herewith wherein the second end 11 thereof has been secured to mounting rod 20 on deployment element 90. The body 10 is planar in manner and includes upper edge 13 and lower edge 15. The body 10 is manufactured from a material such as but not limited to a nylon weave and is operable to inhibit vision therethrough. It is preferred within the scope of the present invention that the body 10 is manufactured so as to inhibit vision therethrough but allow air to pass therethrough. The aforementioned assists in the reduction of structural support required for the body 10 when the body 10 has been deployed to its second position and hundreds of feet of the body 10 has been deployed. It should be understood within the scope of the present invention that numerous materials could be utilized to manufacture the body 10 in order to achieve the desired objectives stated herein. While no particular length of the body 10 is required, good results have been achieved utilizing a body 10 that is six hundred feet in length.

The body 10 further includes an upper cable 22 integrated into the upper edge 13 and a lower cable 24 integrated into the lower edge 15. Both the upper cable 22 and lower cable 24 are steel cables and are provided to ensure structural stability when the body 10 has been deployed to its second position. Intermediate the upper cable 22 and lower cable 24 and perpendicular therewith are support members 25. The support members 25 extend the height of the body 10 and are provided for sag reduction and additional structural support when the body 10 is deployed in its second position. The support members 25 are manufactured from a lightweight material such as but not limited to fiberglass rods. While no particular placement on the body 10 is required, it is preferred within the scope of the present invention that the support members 25 are present every fifteen feet on the body 10. The mounting rod 20 is secured to the deployment element 90 utilizing suitable durable techniques. The mounting rod 20 is secured to the second end 11 of the body 10 upon the need to move the body 10 to its second position. The deployment element 90 is illustrated herein a conventional pickup truck but it is contemplated within the scope of the present invention that the deployment element 90 could be alternate vehicle types or the body 10 could be deployed to its second position manually.

The body 10 is stored in its first position in container 5. In the preferred embodiment of the present invention the container 5 is a towable trailer. Having a towable trailer is desired in order to facilitate the ability for the temporary barrier 100 to be transported to a required location for deployment. While the container 5 in its preferred embodiment is a towable trailer, it is contemplated within the scope of the present invention that the container 5 could be embodied in alternate forms and still achieve the desired objective herein. The container 5 includes a first slot 4 and second slot 3 formed in the rear wall 2. The first slot 4 and second slot 3 are configured to have the body 10 journaled therethrough during deployment of the body 10 to its second position. Having both the first slot 4 and second slot 3 provide an option for deployment based on what side of a road the container 5 is parked and a slot closest to an existing concrete divider is the preferred choice. While two slots are illustrated herein, it is contemplated within the scope of the present invention that the rear wall 2 have only one slot for deployment of the body 10. The first slot 4 and second slot 3 are positioned so as to have the lower edge 15 of the body 10 at a height above the ground of about three feet. This is preferred as in its preferred application the body 10 is positioned so as to extend above a conventional concrete barrier in order to inhibit viewing on the opposing side thereof. By way of example but not limitation, in the event of an accident or construction wherein it is desired to reduce the impact on the traffic flow in an opposing lane, the temporary barrier 100 is positioned adjacent to the concrete barrier and deployed to its second position. Having the height of the lower edge 15 at approximately three feet provides a total combined height of the deployed body 10 and the concrete barrier of about ten feet. This configuration ensures the inability to see over the deployed body 10. While the aforementioned is preferred, it is contemplated within the scope of the present invention that the body 10 could be configured so as to have the lower edge 15 thereof near ground level. In this configuration, the body 10 functions independently to achieve the desired result of visual impairment. Furthermore, in the alternative configuration the temporary barrier system 100 could be utilized to provide containment of an area for a temporary use such as but not limited to a street festival.

Figure 2:
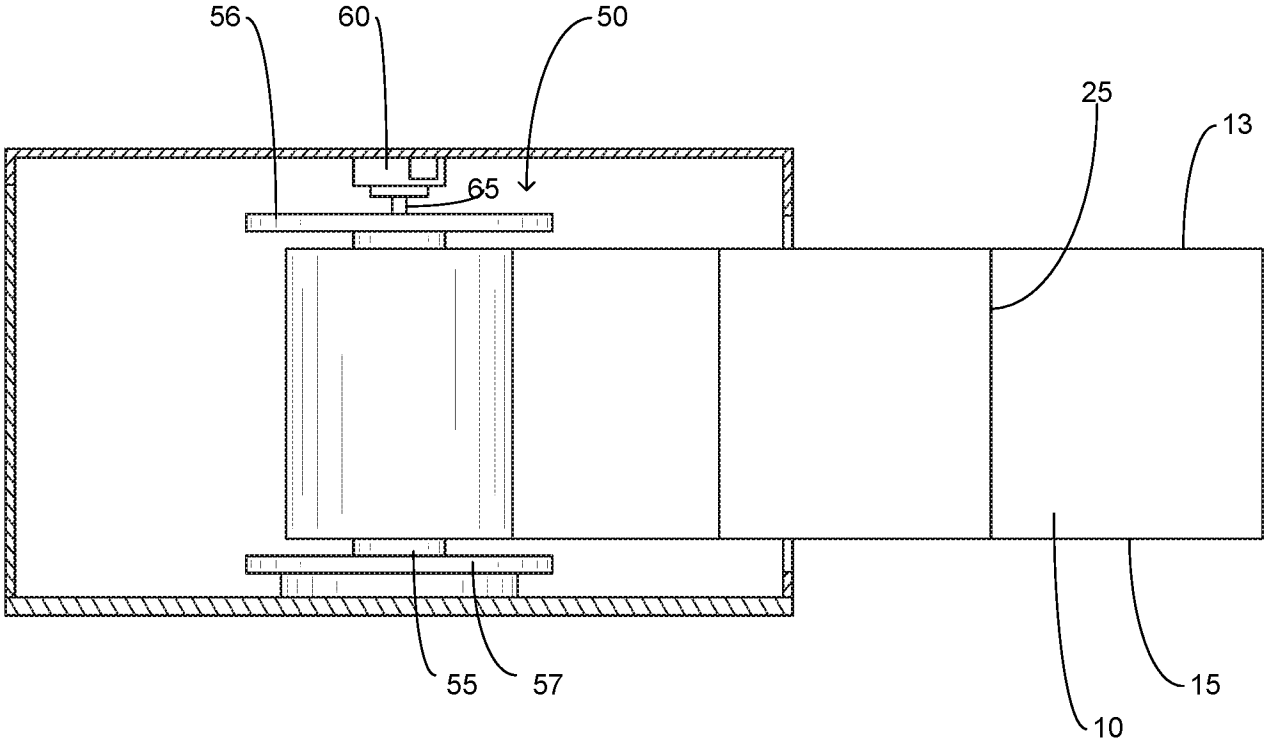
FIG. 2 is detailed view of the winding apparatus of the present invention in the storage container.

Now referring in particular to FIG. 2, the temporary barrier system 100 includes winding apparatus 50. The winding apparatus 50 is configured to provide storage of the body 10 in its first position and deployment of the body 10 to its second position. The winding apparatus 50 includes drum 55 that includes end members 56,57. The drum 55 is configured to have the body 10 wound around thereon with the end members 56,57 providing storage of the body 10 in its first position. The drum 55 is operably coupled to motor 60 via shaft 65. The motor 60 is a conventional electric motor that provides rotation of the drum 55 so as to retrieve the body 10 ensuing deployment thereof. In a preferred embodiment, the motor 60 provides a free-spool rotation of the drum 55 in order to facilitate quicker deployment of the body 10. This is preferred as control of rotation of the drum 55 ensuing attachment of the body 10 to the deployment element 90 could be difficult and result in damage to the body 10. The motor 60 is electrically coupled to a vehicle that is operably coupled with the container 5 so as to provide power thereto. It should be understood within the scope of the present invention that the winding apparatus 50 could be constructed in alternate manners and sizes and still achieve the desired objective discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A temporary barrier system configured to be deployed adjacent a concrete divider on a roadway wherein the temporary barrier system comprises:

a body, said body being planar in manner, said body having a first end and a second end, said body further including an upper edge and a lower edge, said body further including a first support cable, said first support cable being formed in said upper edge, said body further including a second support cable, said second support cable being formed in said lower edge, said first support cable and second support cable operable to provide structural support to said body, said body having a first position and a second position;

a storage container, said storage container having a plurality of walls, a bottom and a top forming an interior volume, said container configured to be movable, said container having a rear wall, said rear wall having a first slot and a second slot, said first slot and said second slot being formed in the rear wall such that the first slot and second slot are parallel and on opposing ends of the rear wall, container configured to store said body in said first position thereof;

a winding apparatus, said winding apparatus being disposed in said interior volume of said storage container, said winding apparatus configured to store said body in said first position;

a deployment automobile, said deployment automobile having a mounting rod, said mounting rod being placed in a vertical position on said deployment automobile, said first end of said body being configured to be releasably secured to said mounting rod; and wherein said deployment automobile is operable to traverse away from said storage container in order to transition said body to said second position.

2. The temporary barrier system as recited in claim 1, wherein said winding apparatus further includes a drum roll, said drum roll having end members on opposing ends of said drum roll, said drum roll configured to have said body wrapped therearound in said first position of said body.

3. The temporary barrier system as recited in claim 2, wherein said storage container is a towable trailer.

4. The temporary barrier system as recited in claim 3, wherein said body further includes a plurality of support members, said plurality of support members being secured within said body intermediate said lower edge and said upper edge being perpendicular therewith, said plurality of support members operable to provide structural support for said body in said second position of said body.

5. The temporary barrier system as recited in claim 4, and further including a motor and shaft assembly, said motor and shaft assembly operably coupled to said winding apparatus, said motor and shaft assembly configured to provide rotational operation of said winding apparatus.

6. The temporary barrier system as recited in claim 5, wherein said body is manufactured of a cloth like material.

7. A temporary barrier system configured to be deployed adjacent a concrete divider on a roadway wherein the temporary barrier system comprises:

a body, said body being planar in manner, said body having a first end and a second end, said body further including an upper edge and a lower edge, said body further including a first support cable, said first support cable being formed in said upper edge, said body further including a second support cable, said second support cable being formed in said lower edge, said first support cable and second support cable operable to provide structural support to said body, said body having a first position and a second position;

a storage container, said storage container having a plurality of walls, a bottom and a top forming an interior volume, said container configured to be movable, said container having a rear wall, said rear wall having a first slot and a second slot formed therein, said first slot and said second slot being parallel with each other and being formed proximate opposing edges of the rear wall, said container configured to store said body in said first position thereof;

a winding apparatus, said winding apparatus being disposed in said interior volume of said storage container, said winding apparatus configured to store said body in said first position, said winding apparatus having a motor and shaft assembly operably coupled thereto, said motor and shaft assembly configured to provide rotational operation of said winding apparatus;

a deployment automobile, said deployment automobile having a mounting rod, said mounting rod being placed in a vertical position on said deployment automobile, said first end of said body being configured to be releasably secured to said mounting rod; and wherein said deployment automobile is operable to traverse away from said storage container ensuing said first end of said body being secured to said mounting rod so as to facilitate the transition of said body to said second position.

8. The temporary barrier system as recited in claim 7, wherein said winding apparatus further includes a drum roll, said drum roll having end members on opposing ends of said drum roll, said end members being perpendicular to said drum roll, said drum roll configured to have said body wrapped therearound in said first position of said body.

9. The temporary barrier system as recited in claim 8, wherein said body is manufactured from a cloth like material that allows passage of air therethrough and inhibits vision therethrough.

10. The temporary barrier system as recited in claim 9, wherein said storage container is a towable trailer.

11. The temporary barrier system as recited in claim 10, wherein said body is configured to be journaled through said first slot or said second slot of said rear wall of said storage container.

12. The temporary barrier system as recited in claim 11, wherein said body further includes a plurality of support members, said plurality of support members being secured within said body intermediate said lower edge and said upper edge being perpendicular therewith, said plurality of support members operable to provide structural support for said body in said second position of said body.

* * * * *